United States Patent [19]

Williams et al.

[11] Patent Number: 4,815,740

[45] Date of Patent: Mar. 28, 1989

[54] ADJUSTABLE GOLF CLUB

[76] Inventors: Joseph Williams, 13300 Indian Rocks Rd., Largo, Fla. 33544; Joseph L. La Mura, 367 Passaic Ave., West Caldwell, N.J. 07006

[21] Appl. No.: 133,742

[22] Filed: Dec. 16, 1987

[51] Int. Cl.[4] ..... A63B 53/02; A63B 53/06

[52] U.S. Cl. ..... 273/80.1; 273/80.2; 403/97

[58] Field of Search ..... 273/79, 80.1, 80.2; 403/93, 97

[56] References Cited

U.S. PATENT DOCUMENTS

| | | | |
|---|---|---|---|
| 198,383 | 6/1964 | Butler . | |
| D. 205,527 | 8/1966 | Andis | 273/80.1 |
| 1,535,707 | 4/1925 | Barnes | 273/79 |
| 1,599,336 | 9/1926 | Lindgren . | |
| 2,138,294 | 11/1938 | Douglas | 273/79 |
| 2,155,830 | 4/1939 | Howard | 273/79 |
| 2,661,952 | 12/1953 | Jackson . | |
| 3,096,982 | 7/1963 | Bassin . | |
| 3,204,962 | 9/1965 | McCormick . | |
| 3,206,206 | 9/1965 | Santosuosso . | |
| 3,214,170 | 10/1965 | Warnock . | |
| 4,240,636 | 12/1980 | Swenson . | |
| 4,289,311 | 9/1981 | Smith . | |
| 4,508,342 | 4/1985 | Drake . | |
| 4,519,612 | 5/1985 | Tsao . | |
| 4,523,758 | 6/1985 | Guendling, Jr. . | |
| 4,614,452 | 9/1986 | Wang | 403/97 X |

FOREIGN PATENT DOCUMENTS

| | | | |
|---|---|---|---|
| 549670 | 8/1956 | Belgium | 273/79 |
| 599655 | 3/1948 | United Kingdom | 273/79 |

*Primary Examiner*—Robert E. Garrett
*Assistant Examiner*—Mark A. Williamson

[57] ABSTRACT

A putter club head has a circular array of like serrations emanating radially from a shaft pivot axis which intersects a shaft longitudinal axis at the mass center of gravity of the head. The shaft is attached to a shank member which rotates around a journal secured to the head. The shank member has a circular array of serrations which mate with and engage serrations on the head. The shank member serrations are releaseably clamped against the head serrations along the pivot axis. A ring circumscribes the interface of the mating serrations to preclude foreign matter from entering into the space between the serrations. The serrations have a given angular spacing to provide known angular positions of the shaft relative to a reference position. A stop device limits the relative angular rotation of the shaft to the head.

23 Claims, 3 Drawing Sheets

FIG. 6
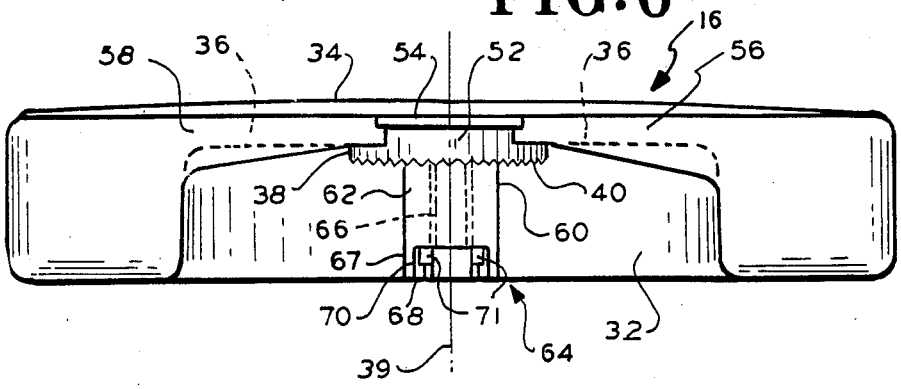
FIG. 4
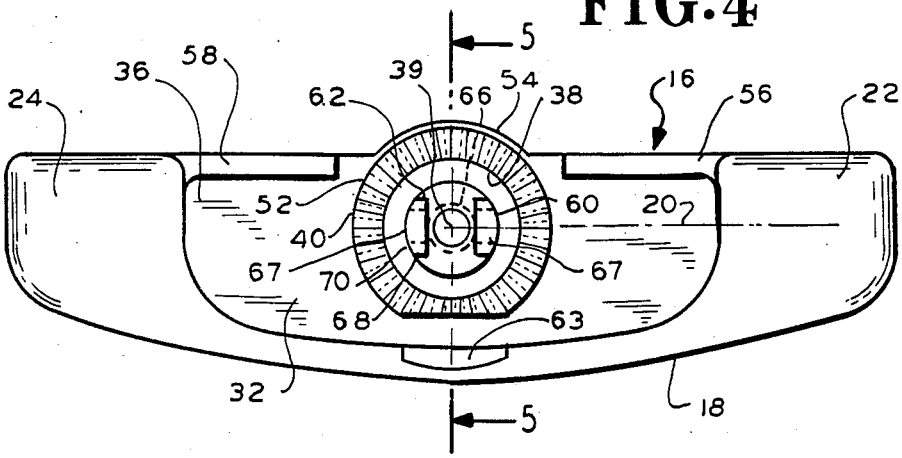
FIG. 8
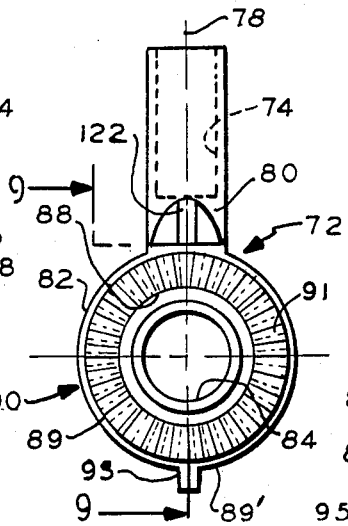
FIG. 9
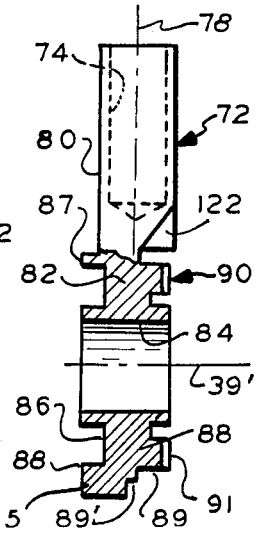
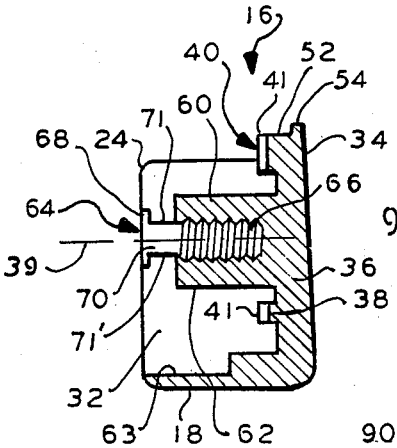
FIG. 5

ADJUSTABLE GOLF CLUB

This invention relates to an adjustable golf club and, more particularly, to an adjustable club with detent means.

Of interest is copending application entitled Adjustable Golf Club Ser. No. 20,699 filed Mar. 2, 1987, by the present inventors.

In U.S. Pat. No. 2,661,952, a double faced club is described employing ball detent means for providing a "four" position club. The shaft is detented to the club head to provide two shaft positions. The head is double faced to permit right and left hand use. The shaft has two positions. Balls on opposite sides simultaneously engage detent depressions. Two separate sets of balls and springs are thus required. Also, a relatively large opening exposes the moving parts to foreign matter. Our copending application also discloses ball detent means. However, the clearance between the balls and their mating apertures may introduce slight but undesirable motion between the club head and shaft.

In U.S. Pat. No. 3,204,962 a detent system uses a peaked member and a plurality of closely spaced detent notches. This arrangement is subject to the drawback of a tendency of the resiliently secured peak to disengage from the notches.

In U.S. Pat. No. 3,096,982 an adjustable club includes a retaining mechanism which makes it difficult to adjust during play. The mechanism includes a tensioning system which needs tools to tighten and loosen the parts to set club positions. Graduated markings are used. The moving parts are exposed to ambient atmosphere and subject to contamination.

U.S. Pat. No. 1,599,366 shows a two position adjustable club. Other adjustable clubs are disclosed in U.S. Pat. Nos. 3,206,206, 3,214,170 and 4,519,612 which suffer from drawbacks similar to those discussed above.

The present inventors recognize a need for a symmetrically balanced adjustable golf club which is capable of a number of incremental angular adjustments about its center of gravity and which are easily made without tools, are reliably repeatable, provide a good "feel" to the user wherein the system is locked securely where set, has an aesthetically pleasing appearance, is sturdy, will survive a large number of adjustments without appreciable wear, and the moving parts are tight fitting to substantially eliminate undesirable movement therebetween. A need is also seen for such a club in which the moving elements are protected from foreign matter which might otherwise interfere with the adjustment mechanism.

An adjustable golf club according to the present invention comprises a club head including a first array of radially extending serrations of like dimension and shape lying in a plane. The serrations extend from a first axis substantially normal to the plane. A shank member includes means for receiving a club shaft on a second axis. The member includes a second array of radially extending serrations positioned to face and dimensioned to engage and mate with the first array with negligible angular play therebetween about the first axis. Bearing means rotatably secure the shank member to the head for rotation about the first axis. The bearing means include means for axially slideably receiving the shank member along the first axis with the arrays facing each other. Clamp means are secured to the head for releasably clamping the first array of serrations to the second array in a direction parallel to the first axis.

In the drawing:

FIG. 4 is a side elevation view of the head member portion of the club of the embodiment of FIG. 1;

FIG. 5 is a sectional end elevation view of the embodiment of FIG. 4 taken along lines 5—5;

FIG. 6 is a plan view of the embodiment of FIG. 5;

Figure 1:
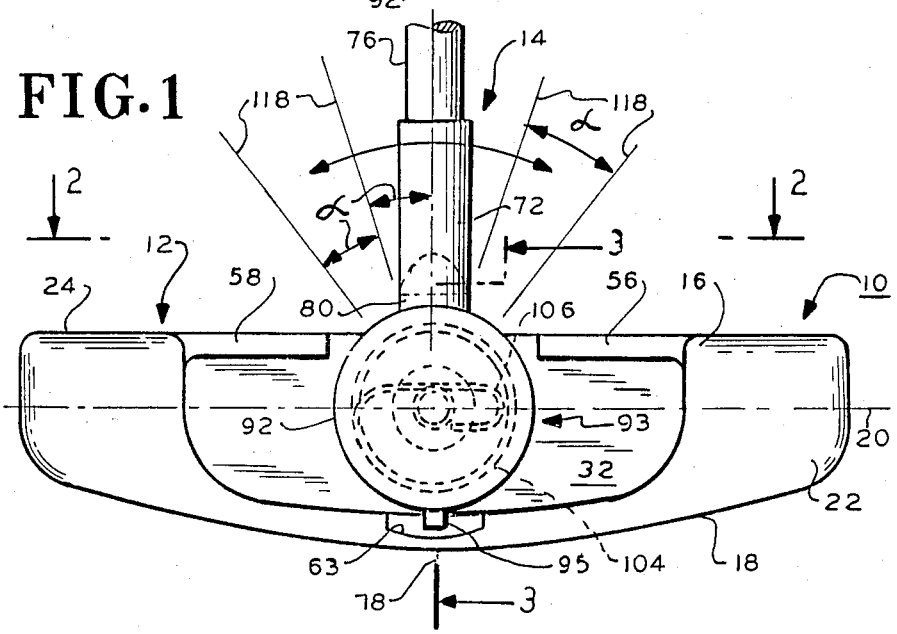
FIG. 1 is a side elevation view of a portion of a golf club according to one embodiment of the present invention.

FIGS. *7a* and *7b* are respective side elevation and plan views of a spring of the embodiment of FIG. 1, FIG. *7a* being taken along lines 7—7 of FIG. *7b;*

FIG. 8 is a front elevation view of the club shaft shank used in the embodiment of FIG. 1.

Figure 10:
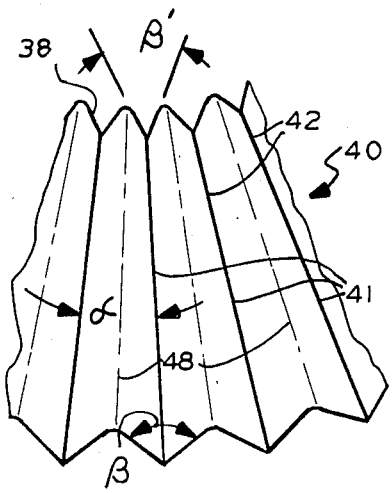
Figure 12:
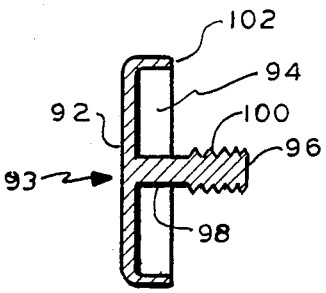
Figure 11:
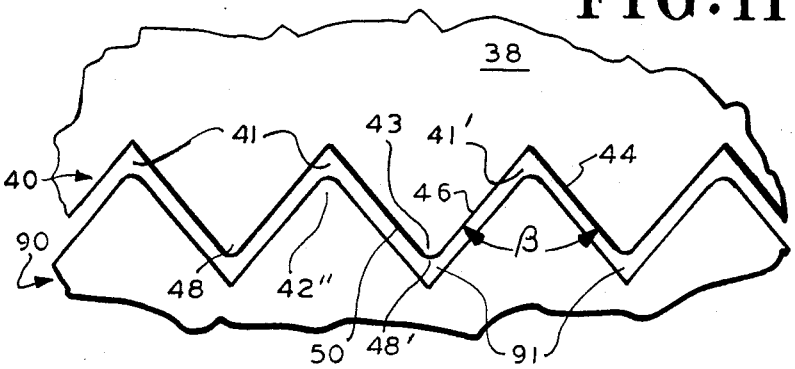

FIG. 9 is a sectional side elevation of the shank of FIG. 8 taken along lines 9—9;

FIG. 10 is a more detailed isometric view of the serrations employed in the present embodiment;

FIG. 11 is a flattened end view of the mating engaged serrations of the shank of FIG. 8 and head member of FIG. 5, and FIG. 12 is a side sectional elevation view of a clamping knob used in the present embodiment.

Figure 2:
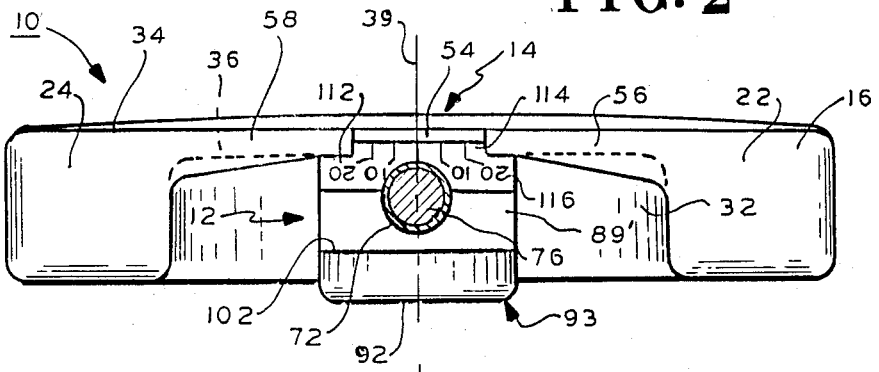
FIG. 2 is a plan view of the embodiment of FIG. 1 taken along lines 2—2.
Figure 3:
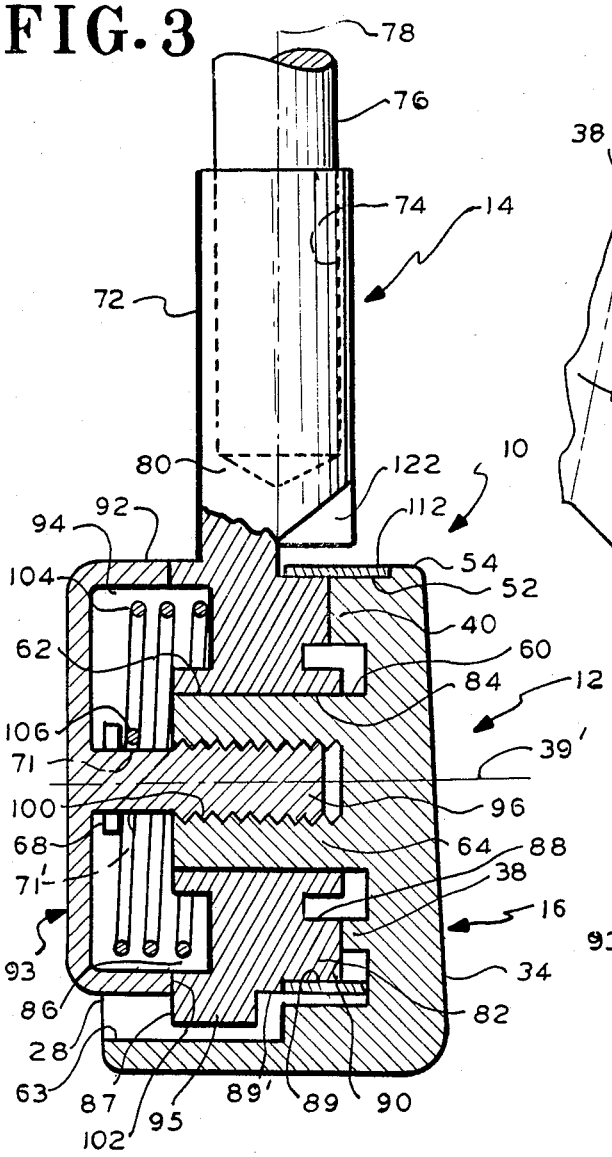
FIG. 3 is a sectional view of the embodiment of FIG. 1 taken along lines 3—3.

In FIGS. 1, 2 and 3 adjustable golf club 10 is illustrated by way of example as a putter but may be other kinds of golf clubs in other implementations. The golf club 10 comprises a head assembly 12 and a shaft assembly 14. The head assembly 12 comprises a head body 16 having a curved sole 18 which is symmetrical with respect to a sole axis 20, FIG. 1. In FIGS. 4, 5 and 6 the head body 16 is an elongated member having two masses 22 and 24 at opposite ends thereof. Body 16 has a symmetrical central cavity 32. The body 16 includes a ball impact surface 34. Surface 34 is on the exterior side of wall 36 which is approximately normal to the sole 18.

Projecting into cavity 32 cantilevered from wall 36 is a circular cylindrical ring-like disk 38 which has a circular array 40 of substantially identical V-shaped serrations 41 radiating from a common axis 39. The serrations 41 have planar side walls as best seen in FIG. 11. In FIG. 11, the serrations are shown slightly disengaged. Representative serration 41', by way of example, is defined by side walls 44 and 46. Serrations 41, FIGS. 10 and 11, each subtend angles $\beta$ and $\beta'$ wherein each serration length uniformly changes in value along the serration length in the range of $\beta'$ to $\beta$ at the respective inner and outer circumferences of ring 38. Angles $\beta'$ and $\beta$ are preferably about 75° and 98° respectively in this embodiment but may lie in a range of approximately 60° 110° in accordance with a given implementation. The 75° to 98° angle range of each serration provides good locking engagement. The crests 48 of the serration teeth are somewhat flattened and rounded as indicated by crest 48' of tooth 43. All of the peaks of the serration array 40 are similarly rounded to preclude engagement of sharpened peaks, if otherwise permitted to exist, with the roots of the mating serrations to be described. Serration array 40 encircles and is concentric with axis 39, FIG. 4. In FIG. 10, the serrations are spaced an angle $\alpha$ which is preferably about 10°.

In FIGS. 4, 5 and 6, an arcuate shoulder 54 upstands from ring 38 outer circular surface 52. Shoulder 54 and surface 52 are concentric with axis 39 and the serration array 40. Body 16 includes a pair of mirror image triangular shaped shoulders 56 and 58 facing inwardly toward each other from respective masses 22 and 24 and cantilevered at one side thereof from wall 36. The shoulders 56 and 58 terminate spaced from disc 38. An arcuate recess 63 is in sole 18 facing cavity 32 and journal 60. A circular cylindrical journal 60 projects from wall 36 centrally within disc 38. Journal 60 has an outer circular cylindrical journal bearing surface 62 which is concentric with axis 39. Journal 60 has an integrally threaded bore 66. A trunnion 64 extends from journal 60 aligned on axis 39.

Trunnion 64 comprises mirror image members 67 each having a stem 70 which projects from journal 60 and a flange 68 at the end of stem 70. Stem 70 has a pair of parallel opposite flat surfaces 71 and 71', FIG. 5, in the region between journal 60 and flange 68.

The club 10 shaft assembly 14, FIG. 3, includes a shank 72 having a bore 74 for receiving club shaft 76 on shaft axis 78. Shank 72 has a neck 80. Secured to neck 80 is a circular cylindrical disk-like member 82, FIGS. 3, 8 and 9. Neck 80 is offset from axis 78 in the region where neck 80 connects member 82 to the shank 72. Member 82 depends at an edge thereof from neck 80 offset from axis 78 as shown. Member 82 has a journal bearing 84 which mates with and is slideably engaged with journal 60 of body 16, FIGS. 4, 5 and 6. Bearing 84 is concentric with axis 39'. Axis 39' is substantially coincident with axis 39 of journal 60, FIG. 5 when journal 60 and bearing 84 mate. Member 82 has a circular recess 86, FIG. 9. On a side of member 82 opposite recess 86 is a ring-like member 88 which projects from member 82 and in which are formed a circular array 90 of serrations 91. Member 88 has a circular outer surface 89 concentric with axis 39'. Member 82 has an outer surface which is raised above surface 89 to form a ridge 89'. Ridge 89' encircles member 82 to neck 80. The serrations 91 are substantially identical in shape, spacing and dimension as the serrations of array 40 in the head body 16 and are in mirror image orientation to array 40. The serrations of array 90 radiate in radial angular spaced relation from axis 39' FIG. 9. A projection 95 depends from ridge 89' parallel to axis 78.

The serrations 91 of array 90 are normally closely engaged and meshed with the serrations 41 of array 40, FIG. 11, with none or substantially negligible backlash about axis 39. Backlash is substantially eliminated because the crests of the serrations 91 of array 90 and the crests 48 of the serrations 41 of array 40 are sufficiently flattened so that the crest tips if otherwise present are precluded from bottoming on the roots of each of the mating serrations. Such bottoming action may cause slight misfit and mis-engagement of the serrations and result in possible loose engagement. By flattening the crests of the serrations, the serration sidewalls of each array 40 and 90 engage in wedge-like action providing a secure, firm locking action between the two serration arrays. The bearing 84 of FIG. 3, extends in a direction parallel to axis 39' the same extent as the serration array 90 to provide a relatively long bearing 84 surface. The bearing 84 mates with bearing surface 62 of journal 60 to provide close sliding and rotational bearing action. With the bearing 84 engaged with journal 60, projection 95 is positioned in recess 63 which provides a limit on the amount of rotation of shank 72 about axis 39, which may be about +/−20°.

In FIGS. 3 and 12 a knob 93 has a cup-like cap 92 having a cavity 94 and from which extends a threaded shaft 96. An annular groove 98, FIG. 12, is in shaft 96 between the threads 100 thereof and cap 92. The groove 98 extends for a sufficient distance between cap 92 and the threads 100 for reasons to be explained. Cap 92 has a planar edge surface 102. Edge surface 102 is parallel to front surface 87 of disk-like member 82, FIG. 3, when the threads 100 are engaged with the threaded bore 66 of journal 60. A circular cylindrical compression spring 104 is engaged with and between member 82 recess 86 and flange 68 of trunnion 64.

Figure 7A:
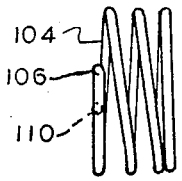
Figure 7B:
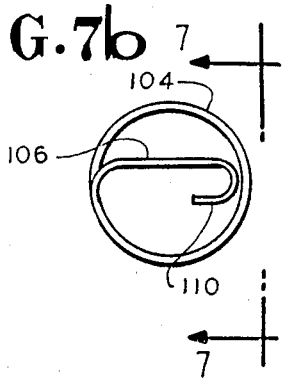

In FIGS. 7*a* and 7*b* compression spring 104 has a circular cylindrical coil as shown. One end of the spring 104 is formed into a U-shaped yoke having legs 106 and 110. Leg 110 is bent from leg 106. The legs are spaced apart a distance about the same as the diameter of knob shaft at groove 98, FIG. 12. Leg 106 is positioned to abut one of the stem 70 surfaces 71 or 71' and engage groove 98 of shaft 96, FIG. 3 when shaft 96 is threaded into journal 60 bore 66. Thus the spring 104 is locked to the shaft 96 of the knob and to the trunnion 64. This precludes the knob from being fully disengaged from the threaded bore 66, body 16 when the knob is loosened.

In FIG. 12, the length of groove 98 between thread 100 and cap 92 is such that the cap 92 can displace axially along axis 39, FIG. 3, an amount sufficient to permit the serration array 90 of shank assembly 14 to axially disengage from the serration array 40 of the head body 16. Spring 104, however, resiliently urges the shank assembly serrations into engagement with the serrations of the head body 16 while permitting them to resiliently disengage. The knob 93 is is unscrewed slightly from the threads 66 of the trunnion 60, e.g., ¾ turn. The amount of axial disengagement is sufficient to permit the serrations to resiliently disengage an amount to permit shaft 76, FIG. 1, to be rotated relative to body 16 and about axais 39.

In FIG. 3, a circular cylindrical sleeve-like ring 112, which may be metal, closely engages the circular cylindrical peripheral surface 52 of the disk 38 and surface 89 of member 82. Ring 112 is juxtaposed over the outer facing edges of the serrations of arrays 40 and 90. Ring 112 completely encircles the interface regions of the edges of the mating engaged serrations of the shaft assembly and head assembly. The ring 112 thus substantially seals these edges from the ambient atmosphere. Thus, entrance of foreign matter into the region between the serrations is significantly alleviated. The ring 112 abuts shoulder 54 in the head body 16, and ridge 89' in the member 82. In FIG. 2, the ring 112 includes a projecting portion 114 which engages wall 36 between shoulders 56 and 58 of the head body 16 locking the ring to the body 16. Ring 112 includes angular indicia 116 for indicating the angular position of the club shaft 76 about axis 39. In FIG. 1, the lines 118 indicate the positions of the shaft 76 which are incremented identical increment amplitudes angle $\alpha$. Angle $\alpha$ preferably has a value of 10° so that the club when positioned 10° from axis 78 is in a position that meets PGA requirements. Each of the shaft positions relative to the head body 16 is in increments of 10°. In this example, the shaft 76 has five positions. Therefore it is relatively easy to ascertain the shaft angular position relative to the club head. When the shaft is rotated ring 112 remains stationary, surface 89 rotatably sliding within the ring.

To assemble the club, the shank 72, FIG. 3, bearing 84 is slipped over journal bearing surface 60 of the head member 16. This aligns the serrations 91 of array 90 on the shank assembly in facing relationship to the serrations 42 of array 40 on the head body. Spring 104 is placed in recess 86 of the shank disc-like member 82 with the spring leg 106 next adjacent to the trunnion 64 flange 68. The leg 106 is assembled so that it abuts surface 71 (or 71') between the flange 68 of trunnion 64 and the end surface of the journal 60. The threaded shaft 96 of the knob 93 is then threaded through the leg 106 into engagement with the journal 60 threads 66. The knob 93 is rotated until the leg 106 is seated in the knob groove 98 (FIG. 12). The leg 106 captures the spring 104 to the journal 60 and to the knob 93, precluding the knob from being entirely disengaged from the threads 66 of the journal 60. In operation, the knob 93 is loosened sufficiently so that the serrations of the shaft assembly 14 can fully disengage from the serrations of the head assembly 12 to permit the user to rotate the shaft to the position of any of broken lines 118, FIG. 1.

Ring 112, FIG. 2, remains captivated to the head body 16 so that the shank 72, member 82 which is closely received therein, can slide relative thereto as it is rotated. The shank 72 includes an arrow 122 formed therein which points toward the ring 112, FIG. 3. The arrow 122 is aligned adjacent to the ring 112 pointed toward indicia 116 to ascertain the angle that the shaft is placed in.

In FIG. 3, the mass center of gravity (CG) of the assembly is located substantially at the intersection of axes 39 and 78. The CG being so located regardless the shaft angular position provides a balanced "feel" to the user permitting accuracy after impact of the head with a golf ball. The impact point of the golf ball (not shown) on axis 39 is along the CG of the club head assembly and is a natural impact point for the club user. The location of the CG of the club to the ball is relatively easy for the user and tends to minimize torquing the club head during impact. Such torque action tends to pivot the club about the shaft axis if the head assembly CG is not aligned with the ball. This torque action tends to be alleviated regardless the shaft angle to the sole axis 20. The serration arrays are so oriented about axis 39 such that the club shaft axis 78 is normal to sole axis 20, FIG. 1, and bearing axis 39, FIG. 2 in one club position. This provides a reference position for the shaft in which the shaft 76 is vertical to the sole axis 20 in one preferred position for play of the putter head. The knob 93 when tightened precludes any motion between the engaged parts which motion might otherwise be present. A simple loosening of the knob permits a user to quickly reorient the club shaft in increments. Once set, the knob is easily clamped in place to securely lock the shaft position where set. The serrations of the shank assembly resiliently engage as the shaft is rotated to provide positive detent action. The circular array of serrations provide a good uniform annular engagement of the shank to the body regardless the relative angular position of the shaft about its pivot axis 39. The knob 93 also covers the spring and provides a finished appearance to the club.

What is claimed is:

1. An adjustable golf club comprising:

a club head including a first array of radially extending serrations of like dimension and shape and lying in a plane, said serrations extending from a first axis substantially normal to said plane;

a shank member including means for receiving a club shaft on a second axis, said member including a second array of radially extending serrations positioned to face and dimensioned to engage and mate with the first array;

bearing means for rotatably securing the shank member to the head for rotation about the first axis, said bearing means including means for axially slideably receiving the shank member along said first axis with the arrays facing each other; and clamp means including a clamp threaded to the head and a compression spring located between the shank member and the clamp for clamping the first array of serrations to the second array in a direction parallel to the first axis, said clamp means including means for attaching the spring to the clamp and to the head such that when the clamp and head threads disengage, said clamp remains attached to the head via the spring.

2. The club of claim 1 further including a member secured to one of said head and shank member for substantially sealing the outer edges of said serrations from ambient foreign material.

3. The club of claim 1 wherein said first and second arrays are circular and concentric with said first axis.

4. The club of claim 3 further including a circular cylindrical ring closely secured over the outer facing edges of said mating serrations for sealing said edges from foreign matter.

5. The club of claim 1 wherein said bearing means includes a circular cylindrical journal secured to one of said head and shank member and a circular cylindrical journal bearing in the other of said shank member and head, said journal and bearing being concentric with said first axis.

6. The club of claim 5 wherein said journal is secured to the head and the bearing is on said shank member, said captivating means includes trunnion means secured to said journal, said journal having a threaded bore dimensioned to receive the threads of said clamp, said trunnion means having at least one surface thereon for receiving and locking the spring thereto, said clamp including means dimensioned to engage the spring for securing the spring thereto.

7. The club of claim 6 wherein said spring includes a leg which abuts the trunnion at least one surface.

8. The club of claim 1 wherein said first and second axes intersect substantially at the club head center of mass gravity.

9. The club of claim 1 wherein said club head includes a first circular cylindrical member concentric with said first axis, said first array of serrations lying in a circle symmetrical with said first axis on an end surface of the cylindrical member; said shank member comprising a second circular cylindrical member concentric with the first axis, said second array of serrations lying in a circle on an end surface of the shank member, the bearing means comprising a journal extending from one of the first and second cylindrical members and a journal bearing formed in the other of said first and second cylindrical members.

10. An adjustable golf club comprising:

a club head including a threaded bore defining a first axis;

a shank member for receiving a shaft on a second axis;

bearing means for rotatably securing the shank member to the head for rotation about said first axis, said bearing means including means for axially slideably receiving the shank member along said first axis;

ratchet means comprising first and second arrays of mating serrations, the first array being secured to said head and the second array being secured to said shank member, said arrays engaging during said slideably receiving and rotatable about said first axis;

a concave clamping cap including a threaded shaft engaged with said threaded bore, said cap having a peripheral edge engaging said shank member, said cap enclosing said bearing means; and a spring between said cap and said shank member and enclosed by said cap for resiliently urging said arrays into engagement.

11. The club of claim 10 wherein the serrations each subtend an angle lying in the range of about 60° to 110°.

12. The club of claim 10 wherein said first and second arrays define a pair of annular circumferential facing edges at the periphery of said serrations, said club further including a ring member secured over said edges for substantially enclosing the edges from the ambient atmosphere.

13. The club of claim 10 wherein said body includes angular indicia adjacent to said shank, and pointing means secured to the shank pointing to the indicia.

14. The club of claim 10 wherein said spring is attached to said cap and to said head to connect the cap to said head regardless the engagement of said shaft to said bore.

15. An adjustable golf club comprising:

a putter head including a first circular array of V-shaped serrations of like shape and dimension radiating from a first axis;

a shank including a club receiving member and a circular disc-like bearing member secured to the club receiving member, said bearing member having a second circular array of serrations of like dimension and shape as the first array and dimensioned to closely engage the first array with negligible backlash, said bearing member defining a second axis from which said second array radiates;

a bearing secured to the head lying on the first axis, said bearing member for rotatable mating with said bearing such that the first and second axes are substantially coincident;

a clamping knob having a threaded shaft extending therefrom threaded to the bearing aligned on the first axis; and a spring secured to the knob and to the head and positioned between the knob and head for urging the shank serrations into engagement with the head serrations, the attachment of the spring to the knob and head being such that the knob remains attached to the head via the spring regardless the engagement of the knob threads to the bearing threads.

16. The club of claim 15 wherein said club includes a circular cylindrical sleeve secured over the edges of said engaged serrations to substantially seal said edges from ambient foreign matter.

17. The club of claim 16 wherein the shank includes a pointer member cantilevered over the sleeve and the sleeve includes angular indicia cooperating with said pointer member.

18. The club of claim 17 wherein the serrations each subtend angles in the range of about 75° to 98°.

19. The club of claim 15 wherein the crests of the serrations are flattened, and the side walls of the serrations are substantially planar.

20. The club of claim 15 further including limit means coupled to said shank and head for limiting the angular rotation of the shank relative to the head.

21. An adjustable golf club comprising:

a club head including a first array of radially extending serrations of like dimension and shape and lying in a plane, said serrations extending from a first axis substantially normal to said plane;

a shank member including a club shaft on a second axis, said member including a second array of radially extending serrations positioned to face and dimensioned to engage and mate with the first array;

bearing means for rotatably securing the shank member to the head for rotation about the first axis, said bearing means including means for axially slideably receiving the shank member along said first axis with the arrays facing each other; and clamp means secured to the head for releaseably clamping the first array of serrations to the second array in a direction parallel to the first axis; and a member secured to one of said head and shank member for substantially sealing the outer edges of said serrations from ambient foreign material.

22. An adjustable golf club comprising:

a club head including a first array of radially extending serrations of like dimension and shape and lying in a plane, said serrations extending from a first axis substantially normal to said plane;

a shank member including a club shaft on a second axis, said member including a second array of radially extending serrations positioned to face and dimensioned to engage and mate with the first array;

bearing means for rotatably securing the shank member to the head for rotation about the first axis, said bearing means including means for axially slideably receiving the shank member along said first axis with the arrays facing each other; and clamp means secured to the head for releaseably clamping the first array of serrations to the second array in a direction parallel to the first axis;

said clamp means including a knob threaded to said head along said first axis, and a spring between the knob and head, said head and knob including means for captivating said knob to said head;

said journal being secured to the head and the bearing being on said shank member, said captivating means including trunnion means secured to said journal, said journal having a threaded bore dimensioned to receive the threads of said knob, said trunnion means having at least one surface thereon for receiving and locking the spring thereto, said knob including means dimensioned to engage the spring for securing the spring thereto.

23. An adjustable golf club comprising:

a body adapted to impact a golf ball, said body having a first angular array of radially oriented V-shaped serrations;

a golf club shank having a second angular array of serrations of like dimension and shape as said first array to mate with and engage the first array, said shank including means for securing a club shaft thereto having a longitudinal axis normal to the given axis;

bearing means secured to the body and shank for rotatably securing the shank to the body for rotation about said given axis and for slideably receiving the shank relative to the body along the given axis; and clamp means for releaseably clamping the second array in engagement with the first array of serrations;

said first and second arrays defining a pair of annular circumferential facing edges at the periphery of said serrations, said club further including a ring member secured over said edges for substantially enclosing the edges from the ambient atmosphere.

* * * * *